US006257630B1

(12) United States Patent
Huang

(10) Patent No.: US 6,257,630 B1
(45) Date of Patent: Jul. 10, 2001

(54) TUBULAR LOCK WITH ADJUSTABLE BACKSET

(75) Inventor: Chao Ming Huang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/425,286

(22) Filed: Oct. 25, 1999

(51) Int. Cl.[7] ..... E05C 1/00
(52) U.S. Cl. ..... 292/1.5; 292/337
(58) Field of Search ..... 292/1.5, 337, DIG. 60, 292/169

(56) References Cited

U.S. PATENT DOCUMENTS 4,711,477 12/1987 Fann et al. ..... 292/169.14
4,746,154 * 5/1988 Fang ..... 292/337
4,750,766 * 6/1988 Shen ..... 292/337
5,149,151 * 9/1992 Shen ..... 292/1.5
5,490,695 * 2/1996 Shiue ..... 292/1.5
5,743,573 * 4/1998 Huang ..... 292/1.5

* cited by examiner

*Primary Examiner*—Gary Estremsky
(74) *Attorney, Agent, or Firm*—Bacon & Thomas, PLLC

(57) ABSTRACT

A tubular lock includes a latch bolt cylinder with a latch bolt that may be extended beyond the doorplate or retracted into the doorplate. A casing consisting of two casing parts is engaged to an inner end of the latch bolt cylinder. An actuating plate is mounted between the casing parts and includes two teeth and a number of protrusions. A follower plate is removably held by the protrusions and also has two teeth. A spindle of the tubular lock bears against the teeth of the follower plate or the actuating plate, thereby allowing the actuating plate to retract the latch bolt directly or indirectly. A movable plate is mounted between the casing parts. The movable plate may be extended beyond the casing parts and includes a positioning hole through which one of two mounting posts of the tubular lock extends.

4 Claims, 3 Drawing Sheets

TUBULAR LOCK WITH ADJUSTABLE BACKSET

U.S. Pat. No. 4,711,477 to Fann et al. issued on Dec. 8, 1987 discloses a duplex latch bolt mechanism that can be adjusted to provide two different backsets. The present invention is intended to provide a different design in this regard.

BACKGROUND OF THE INVENTION

1. Field of the Invention

The present invention relates to a tubular lock with a backset that is adjustable by means of removing a follower plate and moving a movable plate.

2. Description of the Related Art

SUMMARY OF THE INVENTION

It is an object of the present invention to provide a tubular lock that can be adjusted to provide a longer backset and a shorter backset.

A tubular lock in accordance with the present invention includes an actuating plate mounted between two casing parts and having two teeth to be actuated by a spindle when the spindle is rotated. One of two mounting posts is extended through a positioning hole of a movable plate that is also mounted between the two casing parts. The movable plate provides a support to allow the spindle to rotate at a fixed point. The actuating plate includes a number of protrusions for positioning a follower plate. In a shorter backset status, the positioning hole of the movable plate is aligned with positioning holes in the casing parts for mounting one of the mounting posts. In a longer backset status, the follower plate is removed and the movable plate is moved to a longer backset position, wherein said one of the mounting posts is extended through the positioning holes and not extended through the positioning holes of the casing parts.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

Figure 1:
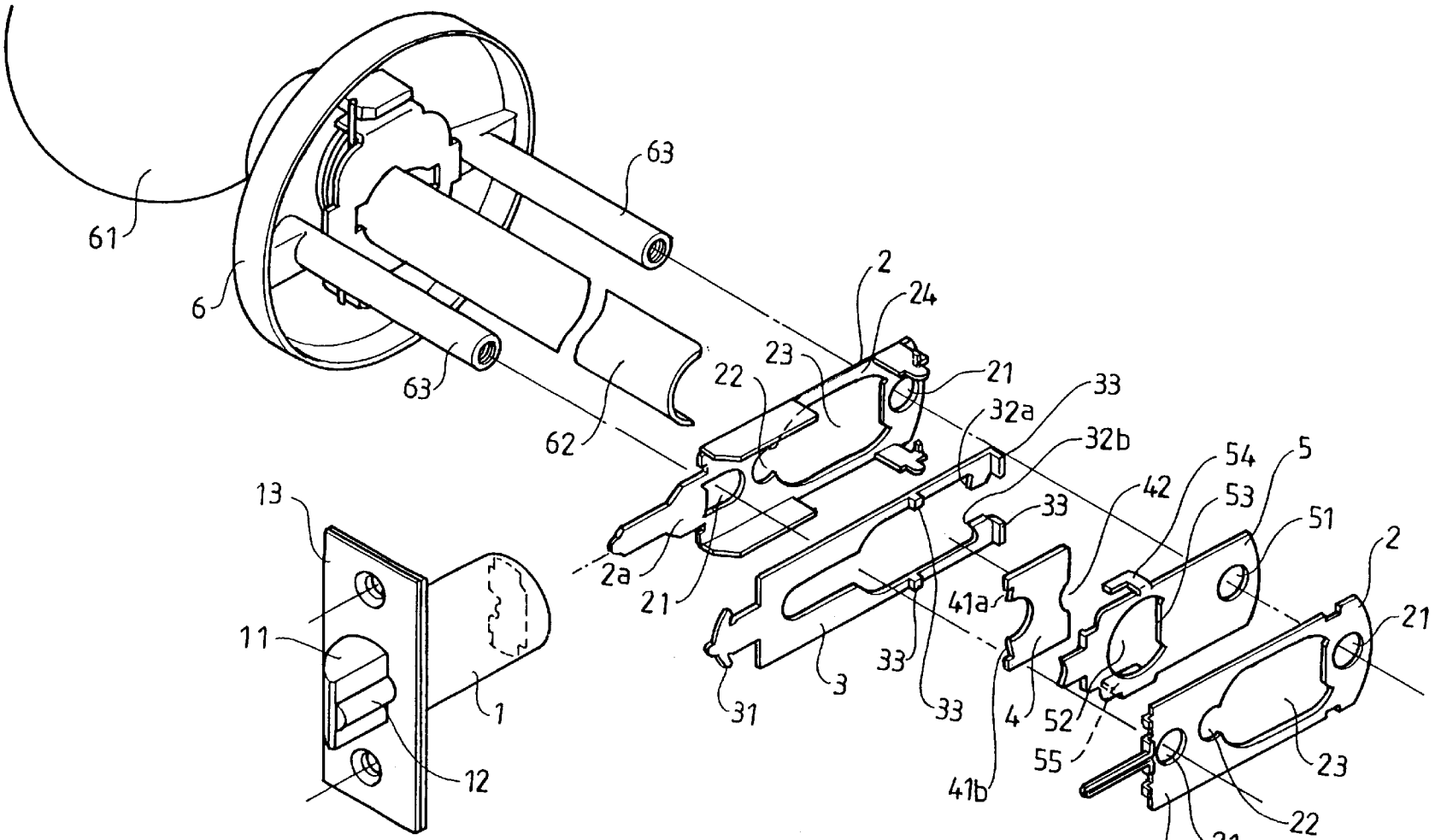
FIG. 1 is an exploded perspective view of a first embodiment of a tubular lock in accordance with the present invention.
Figure 2:
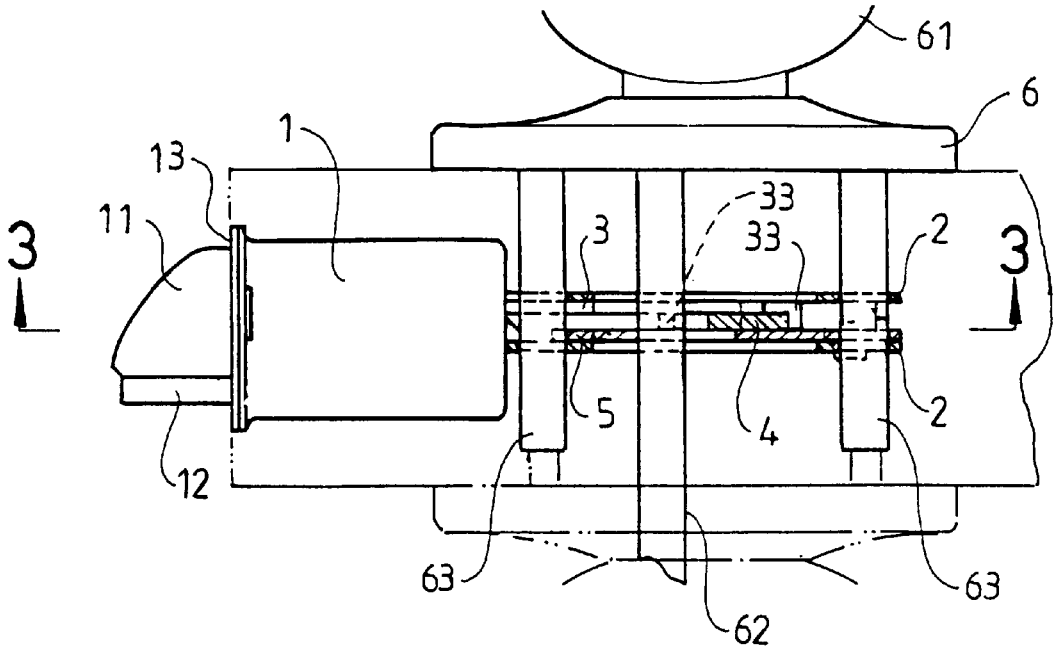
FIG. 2 is a top view, partly sectioned, of the tubular lock in a shorter backset status.
Figure 3:
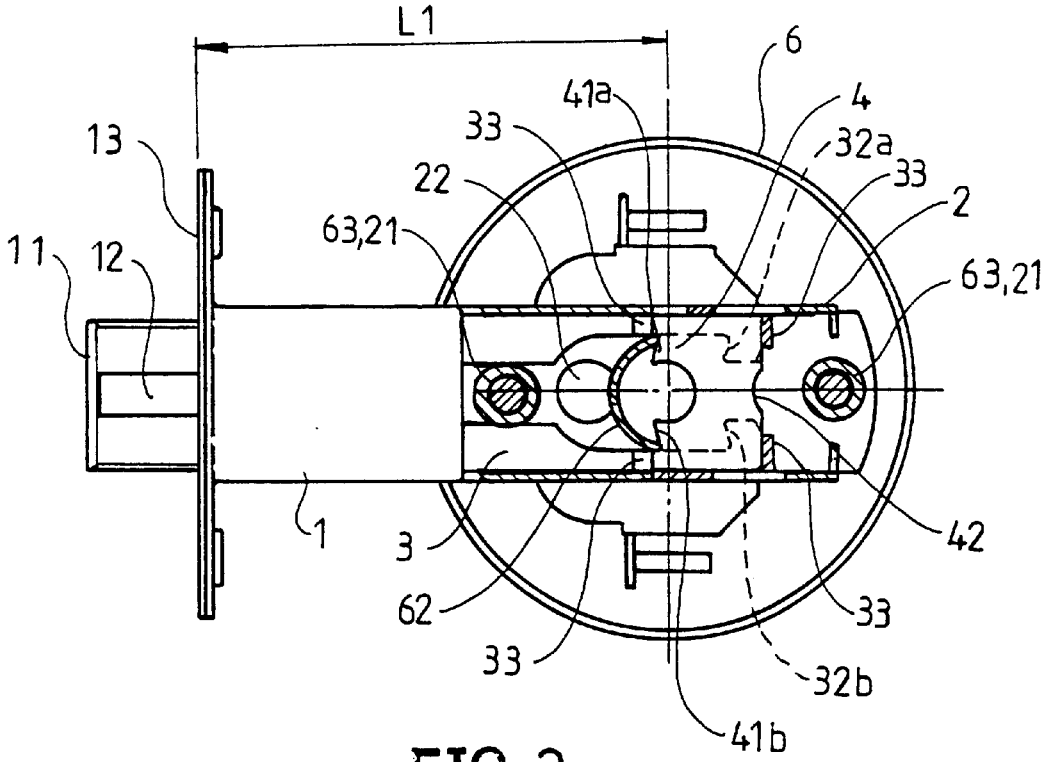
FIG. 3 is a sectional view taken along line 3—3 in FIG. 2.

Referring to FIGS. 1 through 3, a tubular lock in accordance with the present invention generally includes a latch bolt cylinder 1, a casing 2, an actuating plate 3, a follower plate 4, and a movable plate 5. The latch bolt cylinder 1 is conventional and includes a latch bolt 11 and an anti-theft pin 12. The latch bolt 11 can be retracted by the actuating plate 3 into a faceplate 13 (FIG. 4), thereby allowing opening of the doorplate (FIG. 2, not labeled). When the latch bolt 11 is not actuated by the actuating plate 3, the latch bolt 11 is biased outward by an elastic element (not shown) and thus extended beyond the faceplate 13 (FIGS. 3 and 5), thereby locking the doorplate in place.

The casing 2 consists of two casing parts 2*a* and 2*b* that are assembled and then engaged to an inner end of the latch bolt cylinder 1. The actuating plate 3, the follower plate 4, and the movable plate 5 are mounted between the casing parts 2*a* and 2*b*. The casing parts 2*a* and 2*b* include aligned first positioning holes 21 and aligned second positioning holes 22 that are defined by recesses formed in the peripheries of aligned openings 23 through which a spindle 62 of the tubular lock 6 extends.

The actuating plate 3 includes a first end with a hook member 31 for engaging with and thus retracting the latch bolt 11. A second end of the actuating plate 3 includes an upper tooth 32*a* and a lower tooth 32*b*. One of the teeth 32*a*, 32*b* is actuated by the spindle 62 when the spindle 62 of the lock 6 is rotated, such that the actuating plate 3 is moved away from the latch bolt cylinder 1 for retracting the latch bolt 11. A number of protrusions 33 are formed on a side of the actuating plate 3 for positioning the follower plate 44.

The follower plate 4 is mounted between the casing parts 2*a* and 2*b* and removably held in place by the protrusions 33 of the actuating plate 3. The follower plate 4 also has two separate teeth 41*a* and 41*b*. When the spindle 62 of the lock 6 is rotated, one of the teeth 41*a*, 41*b* is actuated by the spindle 62 such that the follower plate 4 and the actuating plate 3 are moved away from the latch bolt cylinder 1 for retracting the latch bolt 11 indirectly.

The movable plate 5 is movably held between the two casing parts 2*a* and 2*b*. The movable plate 5 includes a positioning hole 51 that aligns with inner positioning holes 21 of the casing parts 2*a* and 2*b*. One of two mounting posts 63 of the tubular lock 6 is extended through the inner positioning holes 21 of the casing 2 and the positioning hole 51 of the movable plate 5 when in a shorter backset position. The movable plate 5 further includes an opening 52 through which the spindle 62 of the tubular lock 6 extends. As illustrated, the opening 52 is non-circular and includes an edge 53 that may be engaged with two lateral edges (not labeled) of the spindle 62 for restraining rotational movement of the spindle 62. The movable plate 5 further includes a protrusion 54 that is slidably guided within a slot or notch 24 in the casing part 2*a*, thereby restraining longitudinal movement of the movable plate 5. The movable plate 5 further includes a support 55 formed thereon for supporting the follower plate 4, thereby preventing falling of the follower plate 4.

Referring to FIGS. 2 and 3, when in a shorter backset (L1) status, one of the two mounting rods 63 of the lock 6 is extended through the outer first positioning holes 21 of the casing 2, and the other mounting rod 63 is extended through the inner first positioning holes 21 of the casing 2 and the positioning hole of the movable plate 5. The spindle 62 is extended through the openings 23 of the casing 2 and the opening 52 of the movable plate 5. Two lateral sides of the spindle 52 are in contact with two teeth 41*a* and 41*b* of the follower plate 4, respectively. In addition, the follower plate 4 is securely held by the protrusions 33 of the actuating plate 3.

Figure 4:
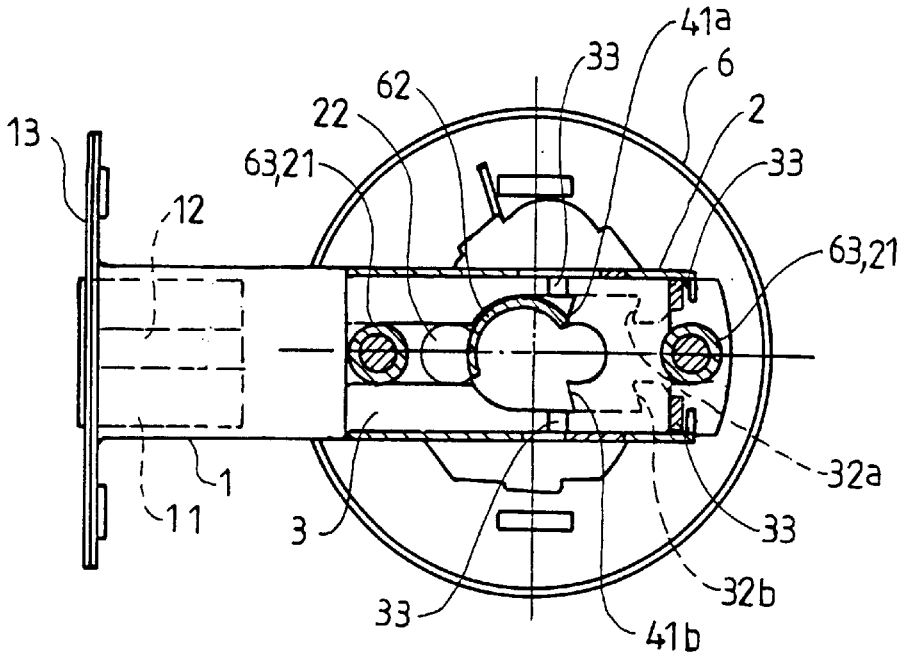
FIG. 4 is a sectional view similar to FIG. 3, wherein the latch bolt is retracted.

Referring to FIG. 4, when the spindle 62 of the lock 6 is rotated, a lateral edge of the spindle 62 bears against the follower plate 4 which, in turn, bears against the actuating plate 3 and thus urges the actuating plate 3 to move away from the latch bolt cylinder 1, thereby retracting the latch bolt 11 into the latch bolt cylinder 1. It is noted that the follower plate 4 includes a recess 42 that receives a portion of the inner mounting rod 63 when the latch bolt 11 is completely retracted.

Figure 5:
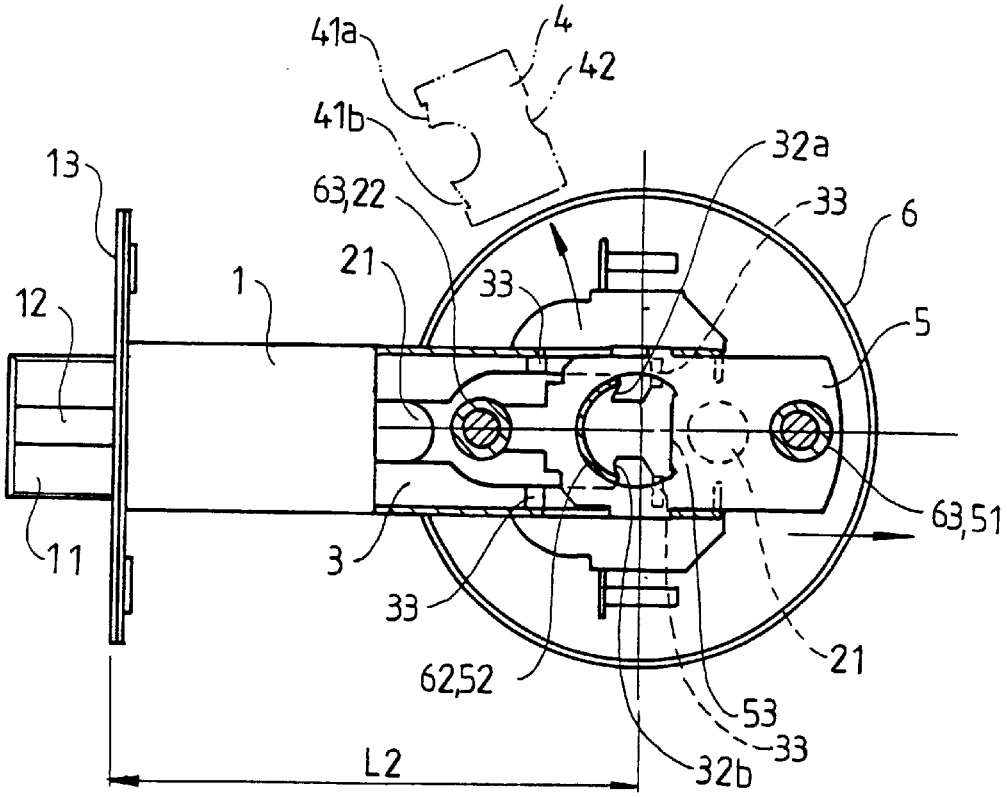
FIG. 5 is a sectional view similar to FIG. 2, wherein the tubular lock is in a longer backset status.

When adjusting the lock 6 from the shorter backset status to the longer backset (L2) status, the follower plate 4 is removed and the movable plate is moved away from the latch bolt cylinder 1 to a position shown in FIG. 5. One of the mounting posts 63 is extended through the second positioning holes 22 of the casing 2. The other mounting post 63 is now extended through the positioning hole of the movable plate 5. In addition, the spindle 62 is extended through the openings 23 of the casing 2 and the opening of the movable plate 52. Two lateral edges of the spindle 62 directly bear against the teeth 32*a* and 32*b* of the actuating plate 3 that retracts the latch bolt 11 directly.

According to the above description, it is appreciated that the follower plate can be removed and the movable plate can be moved relative to the latch bolt cylinder to thereby change the backset for the tubular lock, such that the tubular lock can be used in both backset conditions, and the adjusting operation is simple.

Although the invention has been explained in relation to its preferred embodiment as mentioned above, it is to be understood that many other possible modifications and variations can be made without departing from the spirit and scope of the invention. It is, therefore, contemplated that the appended claims will cover such modifications and variations that fall within the true scope of the invention.

What is claimed is:

1. A tubular lock with an adjustable backset, comprising:

a latch bolt cylinder with a latch bolt that is retractable into or extended beyond a faceplate of the tubular lock, the latch bolt cylinder having an inner end;

two casing parts assembled together to the inner end of the latch bolt, each said casing part including two first positioning holes, and a first opening, the first opening further having a recess in its periphery that defines a second positioning hole;

an actuating plate including a first end operably connected to the latch bolt and a second end with two first teeth and a plurality of protrusions;

a follower plate securely yet removably held by the protrusions ofthe actuating plate, the follower plate including two second teeth and a recess for receiving a portion of a lock mounting rod when the latch bolt is completely retracted; and a movable plate movably mounted between the casing parts, the movable plate being movable between a first backset position and a second backset position, the movable plate including a third positioning hole that is aligned with one of the first positioning holes of each said casing part when the movable plate is in the first backset position, the third positioning hole is moved beyond the casing parts when the movable plate is in the second backset position, the movable plate further including a second opening that aligns with the first opening of each said casing part.

2. The tubular lock as claimed in claim 1, wherein the second opening of the movable plate is non-circular and includes an edge for preventing further rotation of a spindle of the tubular lock.

3. The tubular lock as claimed in claim 1, wherein the movable plate further includes a second protrusion and wherein one of the casing parts includes a notch for restraining movement of the protrusion, thereby restraining movement of the movable plate.

4. The tubular lock as claimed in claim 1, wherein the movable plate includes a support for supporting the follower plate.

* * * * *